US009869451B2

(12) United States Patent
Fornasiero et al.

(10) Patent No.: US 9,869,451 B2
(45) Date of Patent: Jan. 16, 2018

(54) ILLUMINATION DEVICE FOR ILLUMINATING AN ILLUMINATION AREA

(71) Applicant: DRÄGER MEDICAL GMBH, Lübeck (DE)

(72) Inventors: Livio Fornasiero, Bliestorf (DE); Hanno Kretschmann, Hamburg (DE)

(73) Assignee: DRÄGERWERK AG & CO. KGAA, Lübeck (DE)

( * ) Notice: Subject to any disclaimer, the term of this patent is extended or adjusted under 35 U.S.C. 154(b) by 199 days.

(21) Appl. No.: 14/654,923

(22) PCT Filed: Dec. 19, 2013

(86) PCT No.: PCT/EP2013/003874

§ 371 (c)(1),
(2) Date: Jun. 23, 2015

(87) PCT Pub. No.: WO2014/101994

PCT Pub. Date: Jul. 3, 2014

(65) Prior Publication Data

US 2015/0345746 A1 Dec. 3, 2015

(30) Foreign Application Priority Data

Dec. 24, 2012 (DE) ..... 10 2012 025 396

(51) Int. Cl.

| | |
|---|---|
| ***F21V 9/16*** | (2006.01) |
| ***F21V 13/02*** | (2006.01) |
| ***F21V 19/02*** | (2006.01) |
| *F21W 131/20* | (2006.01) |
| *F21W 131/205* | (2006.01) |
| *F21Y 113/10* | (2016.01) |

(52) U.S. Cl.

CPC ..... *F21V 9/16* (2013.01); *F21V 13/02* (2013.01); *F21V 19/02* (2013.01); *F21W 2131/20* (2013.01); *F21W 2131/205* (2013.01); *F21Y 2113/10* (2016.08)

(58) Field of Classification Search

CPC F21V 9/16; F21V 13/02; F21V 19/02; F21W 2131/20; F21W 2131/205; F21Y 2113/10

See application file for complete search history.

(56) References Cited

U.S. PATENT DOCUMENTS

| | | | |
|---|---|---|---|
| 2008/0262316 | A1 | 10/2008 | Ajima et al. |
| 2012/0014086 | A1 | 1/2012 | Jonsson |

(Continued)

FOREIGN PATENT DOCUMENTS

| | | | |
|---|---|---|---|
| CN | 1653297 | A | 8/2005 |
| CN | 1993 075 | A | 7/2007 |
| CN | 102563410 | A | 7/2012 |

(Continued)

*Primary Examiner* — Kristy A Haupt

(74) *Attorney, Agent, or Firm* — McGlew and Tuttle, P.C.

(57) ABSTRACT

An illuminating device (10) for illuminating an illuminated area (110), especially an operating area, has at least one light source (20) with at least one laser (22) for the emission of laser light (L) and at least one exciting medium (30). The exciting medium is excited while absorbing at least part of the laser light (L) and emits emission light (E) of a wavelength that differs at least partly from the wavelength of the laser light (L).

15 Claims, 5 Drawing Sheets

(56) References Cited

U.S. PATENT DOCUMENTS

| | | | |
|---|---|---|---|
| 2012/0281408 | A1 | 11/2012 | Owen et al. |
| 2013/0194551 | A1 | 8/2013 | Zhang et al. |

FOREIGN PATENT DOCUMENTS

| | | | | | |
|---|---|---|---|---|---|
| CN | 102679209 | A | | 9/2012 | |
| DE | 699 34 216 | T2 | | 3/2007 | |
| DE | 20 2007 018 654 | U1 | | 1/2009 | |
| DE | 10 2010 041 319 | A1 | | 3/2012 | |
| DE | 102010039683 | A1 | * | 3/2012 | ..... G02B 27/0994 |
| DE | 10 2010 062465 | A1 | | 6/2012 | |
| DE | 20 2007 019455 | U1 | | 11/2012 | |
| EP | 1 741 974 | A2 | | 1/2007 | |
| JP | 2008 282984 | A | | 11/2008 | |
| NL | WO 2012023090 | A1 | * | 2/2012 | ..... F21V 23/04 |
| WO | 03/096387 | A2 | | 11/2003 | |
| WO | 2012/023 090 | A1 | | 2/2012 | |
| WO | 2012/025339 | A1 | | 3/2012 | |

* cited by examiner

ILLUMINATION DEVICE FOR ILLUMINATING AN ILLUMINATION AREA

CROSS REFERENCE TO RELATED APPLICATIONS

This application is a United States National Phase Application of International Application PCT/EP2013/003874 filed Dec. 19, 2013 and claims the benefit of priority under 35 U.S.C. §119 of German Patent Application DE 10 2012 025 396.6 filed Dec. 24, 2012, the entire contents of which are incorporated herein by reference.

FIELD OF THE INVENTION

The present invention pertains to an illuminating device for illuminating an illuminated area, especially an operating area, as well as to a lighting fixture for an operating room for illuminating an illuminated area in the form of an operating area.

BACKGROUND OF THE INVENTION

Illuminating devices for illuminating an illuminated area are known, in principle. Such illuminating devices are used, in particular, as lighting fixtures for operating rooms for illuminating an illuminated area in the form of an operating area. The goal is to provide an especially natural and bright illumination in an operating area, i.e., in the area of the surgical wound. The classical embodiment of such illuminating devices has classical illuminating means, e.g., in the form of gas discharge lamps. These gas discharge lamps are known to provide a sufficiently bright light, especially with a large blue component, and correspondingly an especially white light. The light has a good color rendering index and correspondingly high color fastness in the illuminated area. It is also known already that LEDs are used as a newer illuminating means for the illuminating devices. However, the output of an individual LED for this is not sufficient for providing the necessary brightness. Thus, a plurality of LEDs, which are arranged, e.g., in the form of a matrix, are frequently used in prior-art illuminating devices.

The drawback of prior-art illuminating devices is, on the one hand, the development of heat. A large part of the energy consumed is converted into heat especially in case of halogen lamps, but also in gas discharge lamps. The high-output LEDs needed for illuminating devices also generate a rather substantial amount of waste heat. However, the heat generated is disadvantageous, because it inconveniences the surgeon. In addition, the release of heat leads to thermal up-current, which interferes with the air flow in the area of the illuminated area. If the illuminated area is an operating area, the most sterile situation possible must be created there. If this stable situation is interfered with by thermal flows, the risk of contamination with microorganisms of the surgical wound, which is located in the illuminated area, increases. It is also disadvantageous that a rather appreciable percentage of infrared light is emitted in prior-art gas discharge lamps we well as in prior-art halogen lamps. This infrared light component leads to the risk of desiccation of the surgical wound when reaching the illuminated areas in the form of a surgical wound, and is likewise disadvantageous. Moreover, the consequence is an unpleasant scene in case of the use of LEDs and the correspondingly distributed arrangement in the corresponding light source. Thus, shadowing can be assumed here, which has an adverse effect as a partial shadowing on the color rendering and the visibility in the illuminated area for the surgeon. A complicated optical system is also necessary to bundle this plurality of LEDs and to guide them in the desired manner. This leads to markedly intensified costs in case of prior-art illuminating devices, and efficiency is reduced.

SUMMARY OF THE INVENTION

An object of the present invention is to eliminate the above-described drawbacks at least partially. Another object of the present invention is, in particular, to provide an illuminating device for illuminating an illuminated area as well as a lighting fixture for an operating room for illuminating an illuminated area in the form of an operating area, which are able to produce an improved illumination situation in the illuminated area in a cost-effective and simple manner.

Features and details that are described in connection with the illuminating device according to the present invention do, of course, also apply in connection with the lighting fixture according to the present invention for an operating room and vice versa, so that reference is or can always be mutually made to the individual aspects of the present invention concerning the disclosure.

An illuminating device according to the present invention is used to illuminate an illuminated area, especially an operating area. Such an illuminating device has at least one light source with at least one laser for emitting laser light. Further, at least one exciting medium is provided, which is excited while absorbing at least part of the laser light and emits emission light of a wavelength or a wavelength spectrum. The wavelength range of the emission light differs at least partly from the wavelength of the laser light. The exciting medium may advantageously comprise a medium which scatters a non-absorbed part of the laser light and at least partially destroys the spatial coherence thereof.

Simple laser light that can be made available in a cost-effective manner can be used by means of an illuminating device according to the present invention. The drawback that the laser light is monochromatic light of a single wavelength is eliminated by the conversion by means of the exciting medium. For example, a luminophore or a photoluminescing material may be used as the exciting medium. Laser light can raise electrons in such a photoluminescing material to higher energy levels. The laser light is absorbed at least partially in the process. When the electrons jump back from these higher energy levels, the energy being released is released as photon with an energy lower than that the absorbed laser photon.

Consequently, conversion of at least part of the laser light into emission light can take place in an illuminating device according to the present invention. The desired wavelength of the emission light or even an entire frequency band of different wavelengths can be defined for the emission light in a cost-effective and simple manner by selecting the laser light and by correspondingly designing the exciting medium.

Contrary to classical gas discharge lamps, a cold light source can be made available by means of laser light. All drawbacks concerning the development of heat and the thermal flow generated as well as the effect of heat on the surgeon are eliminated in this manner. It can also be achieved by selecting the exciting medium that infrared components are explicitly excluded in the emission light. The described desiccation of the operating area, i.e., the surgical wound in the illuminated area, can likewise be reduced in this manner.

Not least, a great advantage of an illuminating device according to the present invention is that by selecting the exciting medium correspondingly in correlation with the laser, it is possible to select a mixture of laser light and emission light or even the emission light only, such that an especially high color fastness can be achieved in the form of a good color rendering index. Based on the good spatial beam quality (excellent possibility of focusing, small beam diameter) of laser light, it is possible to develop a very small optical system, in which the excitation takes place, and then to focus or collimate the mixed light consisting of laser light and emission light in order to guide it in the direction of the workplace (e.g., wound field). Since simple, smaller optical systems can be manufactured more easily and better, advantages arise in terms of the efficiency of the optical system and the costs thereof.

An illuminating device according to the present invention is operated especially as a lighting fixture for an operating room. An especially advantageous color rendering can thus be achieved concerning the color rendering index to the extent that an especially natural color rendering can be made available for the surgeon in the surgical wound.

The exciting medium may be designed at least partially as a diffuser and correspondingly fan out the entering laser light. This fanning out and the at least partial absorption reduces the energy density of the laser light, so that protection of the eyes can be effectively achieved in this manner.

In the sense of the present invention, laser light is especially monochromatic light, which is formed preferably with a short wavelength in the blue range and/or UV range. The passage of the light through the exciting medium may take place both as reflection, scattering and/or also as transmission. This means that for its excitation and absorption, the laser light can be reflected at least partially from the exciting medium and transmitted at least partially through the exciting medium.

In the sense of the present invention, a plurality of optical components may, of course, be provided both between the light source in the form of the laser and the exciting medium and downstream of the exciting medium. These are, e.g., reflector screens or small reflectors, lenses or even diaphragms. Protective glasses in the form of closing panes are also conceivable in the sense of the present invention.

It is advantageous if an especially high percentage of the laser light is absorbed and thus converted into emission light. It is preferred if more than about 90% of the laser light is absorbed and converted into emission light. This causes the major percentage of the energy of the laser light to be converted into emission light. The residual laser light thus decreases in the light which is radiated from the illuminating device. The hazard to the eyes of the staff located in the surrounding area can be markedly reduced in this manner. It is especially preferred if the exciting medium is designed not only for the conversion of an individual wavelength, but for generating the broadest possible spectrum, especially in the blue range.

It may be advantageous if the exciting medium is designed in an illuminating device according to the present invention to emit a spectrum of different frequencies, especially in the form of a frequency band, as an emission light, by excitation by the laser light. A spectrum of different frequencies may be, e.g., a spectrum of different frequency peaks. However, it is preferably a frequency band with the most uniform expression possible of the different wavelengths. It should be noted in this connection that the terms "frequency" and "wavelength" are used as synonyms in the present application. The provision of an exciting medium, which emits a spectrum of different frequencies, especially in the form of a frequency band, as an emission light, generates an especially advantageous illumination in the illuminated area. In particular, a spectrum that provides an especially high color rendering index can be provided in a specific manner. It is thus possible, ultimately, to make available quasi especially white light. The spectrum preferably takes into account the degree of absorption of the laser light, so that the light in the illuminated area is ultimately generated, e.g., by a combination of non-absorbed laser light and emitted emission light.

It is possible now that the exciting medium is designed in an illuminating device to emit a spectrum in the visible spectral range by excitation by the laser light. The exciting medium is designed, in particular, to emit a spectrum in the visible spectral range with high color rendering values (Ra, Rx, x=1 to 15, some or all >80) by excitation by the laser light.

It may be advantageous if the exciting medium in an illuminating device according to the present invention is designed as a solid crystal doped with ions as a ceramic, casting or powder prepared from glass or from these materials. Further, it is possible that the exciting medium in an illuminating device according to the present invention is an oxidic or fluoridic crystal, e.g., a YAG, YLF, YalO, YVO, GbVO ( . . . LF) or an oxidic or fluoridic glass. It is also possible that the doped ions contain at least partially Ce, Pr or Er or combinations thereof. It is likewise advantageous if the exciting medium in an illuminating device according to the present invention is a dye or luminophore or contains such.

It is advantageous, moreover, if at least one optical component is arranged in the illuminating device according to the present invention such that it guides, e.g., focuses the laser light onto the exciting medium. Such an optical component may be used, e.g., for active light control. Thus, a diaphragm, a reflector, an optical light guide or a lens may be used to move the laser light in a corresponding manner. For example, mirrors are conceivable, which may be used as optical components. The active light control may be used now as focusing for the laser light. Splitting of the laser light among different exciting media is also conceivable. In addition or as an alternative, there may be a collection of light from a plurality of lasers in the optical components onto one and the same exciting medium.

Further, it is advantageous if at least one of the following optical components is provided in an illuminating device according to the present invention:

Reflector
Diaphragm
Optical light guide
Lens
Diffractive optical system.

Based on the above optical components, whose list is not complete, there is an even greater freedom in arranging the laser. It is thus possible that the laser can be set up independently from the housing of the illuminating device. It is even conceivable, in principle, to accommodate the laser in a separate space in order to reduce the effect of the operating room even more. The laser light can be brought in this manner to the desired position, for example, by means of an optical light guide and focused on the exciting medium. This can be embodied in a simple manner because laser light has a high spatial beam quality. The optical light guide is designed here, e.g., as a TIR (Total Internal Reflection) body. The optical component, especially in the form of such an optical light guide, can in this case be used to improve the homogeneity of the laser light. Homogenization of the laser light can thus be brought about in this manner over a defined cross section, which preferably corresponds to the impact cross section of the exciting medium. The emission of the emission light can thus be brought about in an even more specific manner. A symmetrical focus, which is helpful for the further optical imaging, will also become possible in this manner. Such an optical light guide may also be used to homogenize the light, especially the laser light and/or emission light, even more strongly, especially in an active manner.

Further, it is advantageous if the at least one optical component, especially in the form of an optical light guide, has or incorporates the exciting medium at least partially in an illuminating device according to the present invention. The optical light guide can thus have, e.g., structures that are photoluminescing. The excitation and hence the conversion into the emission light can thus take place already when the laser light is optically influenced by the guiding in the optical light guide. In particular, the optical components are designed in this case such that no free laser light or only as much laser light as is necessary for generating an optimal light spectrum with high color rendering will leave the illuminating device in the direction of the illuminated area. Sufficient protection can thus be made available to protect the eyes of the surrounding persons. In another approach, the spatial coherence of the laser light can be reduced, for example, by induced scattering after passing through the optical light guide and partial conversion into broad-spectrum emission light. This also leads to increased protection of the eyes. The illuminating device can consequently integrate the exciting medium at least partially in one of the optical components.

It may be advantageous if the exciting medium itself assumes the function of an optical light guide or waveguide for the laser light or is designed as such in an illuminating device according to the present invention. It is also possible that the exciting medium scatters the non-absorbed component of the laser light in an illuminating device according to the present invention and destroys thereby the spatial coherence thereof at least partially. Further, it is possible that the exciting medium reflects laser light and/or emission light on its surfaces at least partially in order to guide it in a desired direction. The reflection may be generated by metalized surfaces. The reflection may also be a total reflection.

Further, it is likewise advantageous if the exciting medium in an illuminating device according to the present invention has at least two excitation sections, which emit mutually different spectra of emission light while absorbing the laser light. Different frequency spectra of emission light are generated by the chemical differentiation of the materials for the two excitation sections. The exciting medium with two different excitation sections is preferably exposed to the same laser light. Active switching over or a design-based variation and/or mixing of the spectra of the two emission lights can take place due to this embodiment. For example, the illumination by the illuminating device may be country-specific. The illumination by the emission light can be changed by switching over and correspondingly changing the excitation sections or the focusing of the laser light. For example, excitation of marker dyes, so-called tumor markers, may take place as an alternative to a country-specific type of illumination. A spectrum of emission light that leads, for example, to the fluorescence of such marker dyes can be made available this way in a specific manner. An illuminating device can thus make available a great variety of illumination situations in a cost-effective manner, rapidly and simply by simple switching over of the excitation sections and without changing the actual light source. It is also possible that different excitation sections are exposed to the light together, so that a mixing of light will take place in the emission light. A sequential arrangement one after another is advantageous here, so that a laser light beam radiates through two or more excitation sections one after another and generates in the process different emission spectra, whose sum generates the light of the lighting fixture for the operating room together with the remaining, non-absorbed laser light.

The present invention can be further perfected such that the exciting medium is arranged in the illuminating device movably, especially rotatably, in the illuminating device in order to move each time one of the excitation sections into the focus of the laser light. The mobility is brought about, e.g., by means of a mechanism or actuation by an electric motor. Manual motion or rotation of the exciting medium is also conceivable. Switching over of the emission light can be brought about in this manner actively by the user of an illuminating device according to the present invention. Flexible adaptation to the particular use situation, i.e., for example, to the particular surgical situation, is thus possible. It is also possible for the light source to comprise a laser with laser light in the UV or blue spectral range in an illuminating device according to the present invention. The light source may in this case have a laser with laser light in the range of about 395 nm to about 420 nm, preferably close to about 405 nm. It is also possible for the light source to have a laser with a laser light in the range of about 445 nm to 475 nm, preferably close to 455 nm.

It is advantageous, moreover, if the light source in an illuminating device according to the present invention has at least two lasers, which emit laser light with different wavelengths. This embodiment may be used with a uniform exciting medium and with an exciting medium with different excitation sections alike. Different excitations can thus be achieved at the exciting medium by means of a light source with at least two lasers. The percentage of laser light that is not absorbed and correspondingly brings about the illumination in the mixture with the emission light can also entail in this manner a shift of the entire illumination spectrum. The lasers may preferably have different shades of blue in order to create a greater breadth in the blue spectrum. The two lasers may be operated in this case separately from one another or even together, quasi in parallel. As an alternative, one of the lasers may also be in the red spectral range or in another spectral range in order to stress special color ranges in the illumination spectrum or to optimize individual color rendering ranges or the general color rendering range.

Further, it is advantageous if the laser and/or the exciting medium in an illuminating device is designed for the emission of laser light and/or emission light with a UV component in a frequency range and with an energy density that are suitable for the disinfection of the illuminated area. The UV disinfection can thus deactivate microorganisms or bacteria in the area of the illuminated area in at least some sections. This necessary UV component may be provided, of course, by the laser light alone, the emission light alone or a combination of laser light and emission light. As an alternative, a wavelength of about 405 nm is, of course, of interest as well. The disinfection preferably takes place with respect to microorganisms typically occurring in hospitals. It is possible in this case that the laser and/or the exciting medium in an illuminating device according to the present invention is designed for the emission of laser light and/or emission light with a substantial light component at a wavelength of about 405 nm, which are suitable for disinfecting the illuminated area. Further, it is possible that the laser and/or the exciting medium are designed for the emission of laser light and/or emission light with a substantial light component for exciting a marker dye.

The present invention also pertains to a lighting fixture for an operating room for illuminating an illuminated area in the form of an operating area. Such a lighting fixture for an operating room is characterized in that at least one illuminating device is provided with the features of the present invention. A lighting fixture according to the present invention for an operating room correspondingly entails the same advantages as they were explained in detail in reference to an illuminating device according to the present invention.

A lighting fixture according to the present invention for an operating room can be perfected in such a way that a plurality of illuminating devices are provided, which are arranged movably in relation to one another. Both a combination of an illuminating device according to the present invention with classical illuminating devices and an exclusive design according to the present invention for all illuminating devices may be provided here. Different types of lasers and different exciting media can thus be combined with one another in order to make different frequency spectra available. A common light source and preferably a single laser may also be used for branching among all illuminating devices in order to further reduce the costs. It is possible in this case that one or more illuminating devices or parts thereof are arranged movably within the lighting fixture for the operating room in order to make the parameters of the illuminated field of the lighting fixture for the operating room adjustable by motion.

The present invention will be explained in more detail on the basis of the drawing figures attached. The terms "left," "right" and "at the bottom" being used here refer to an orientation of the drawing figures with normally legible reference numbers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
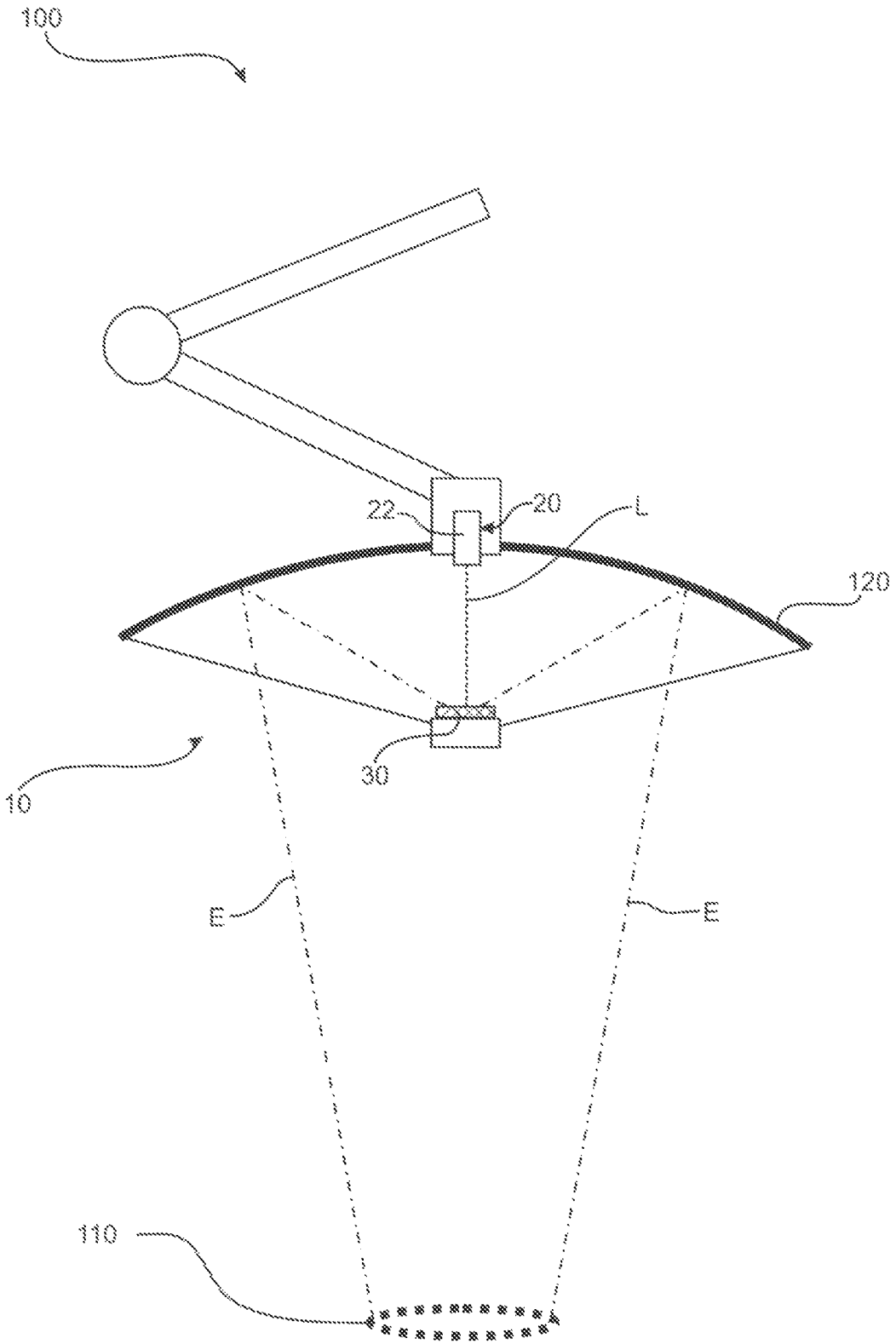
FIG. 1 is a schematic view showing a first embodiment of an illuminating device according to the present invention.

Referring to the drawings, FIG. 1 shows a first embodiment of an illuminating device 10 according to the present invention. It is a lighting fixture 100 for an operating room, which is provided with a reflector 120 in the form of a lampshade. Emission light E can be guided into an illuminated area 110 by means of the reflector 120.

To make the desired emission light E available in this embodiment of the illuminating device 10, a light source 20 with a laser 22 is provided. Laser light L is emitted in the direction of an exciting medium 30. The exciting medium 30 will perform an essentially complete absorption of the laser light L and emit emission light E, which is in turn reflected by the reflector 120 in the direction of the illuminated area 110.

The conversion of the laser light L into emission light E is used in this embodiment to change the spectrum, which is present in the illuminated area 110.

Figure 7:
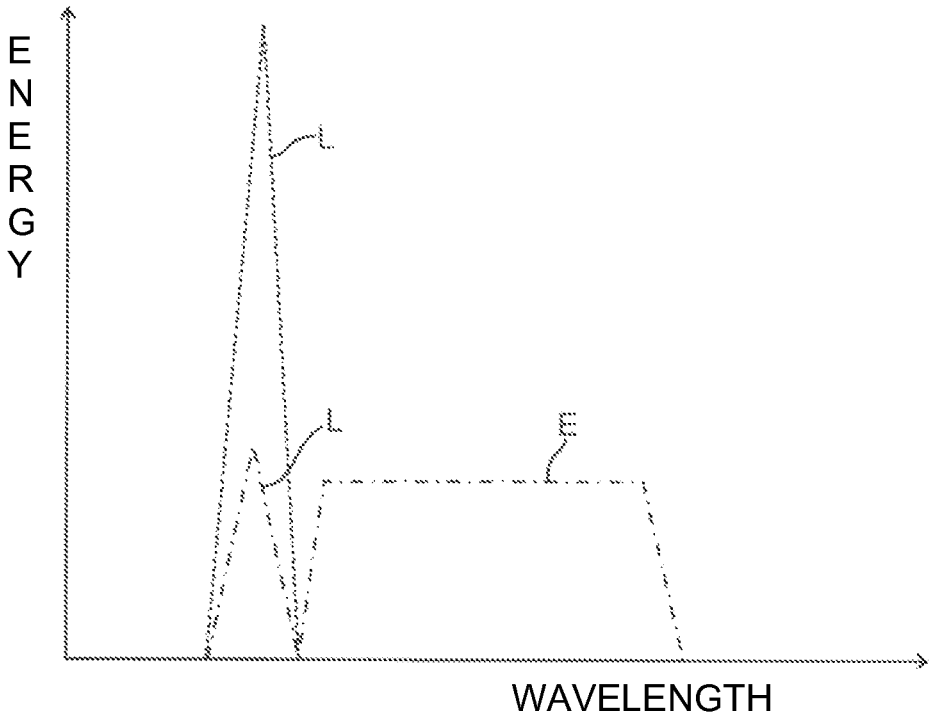
FIG. 7 is a diagram showing a comparison of the emission spectra with the spectrum of the laser light.

The change of the spectrum for all embodiment variants of the present invention is shown as an example in FIG. 7. Thus, laser light L (indicated by broken line) with a very narrow spectrum, e.g., in the blue range, is made available. A large part of the laser light L is subsequently absorbed at the exciting medium 30 from this wavelength with high energy density. This absorbed energy is converted into new emission light E, which preferably provides a broad frequency band of different wavelengths compared to the laser light. This conversion is shown in the emission light E (indicated by dash-dotted line in FIG. 7).

Figure 2:
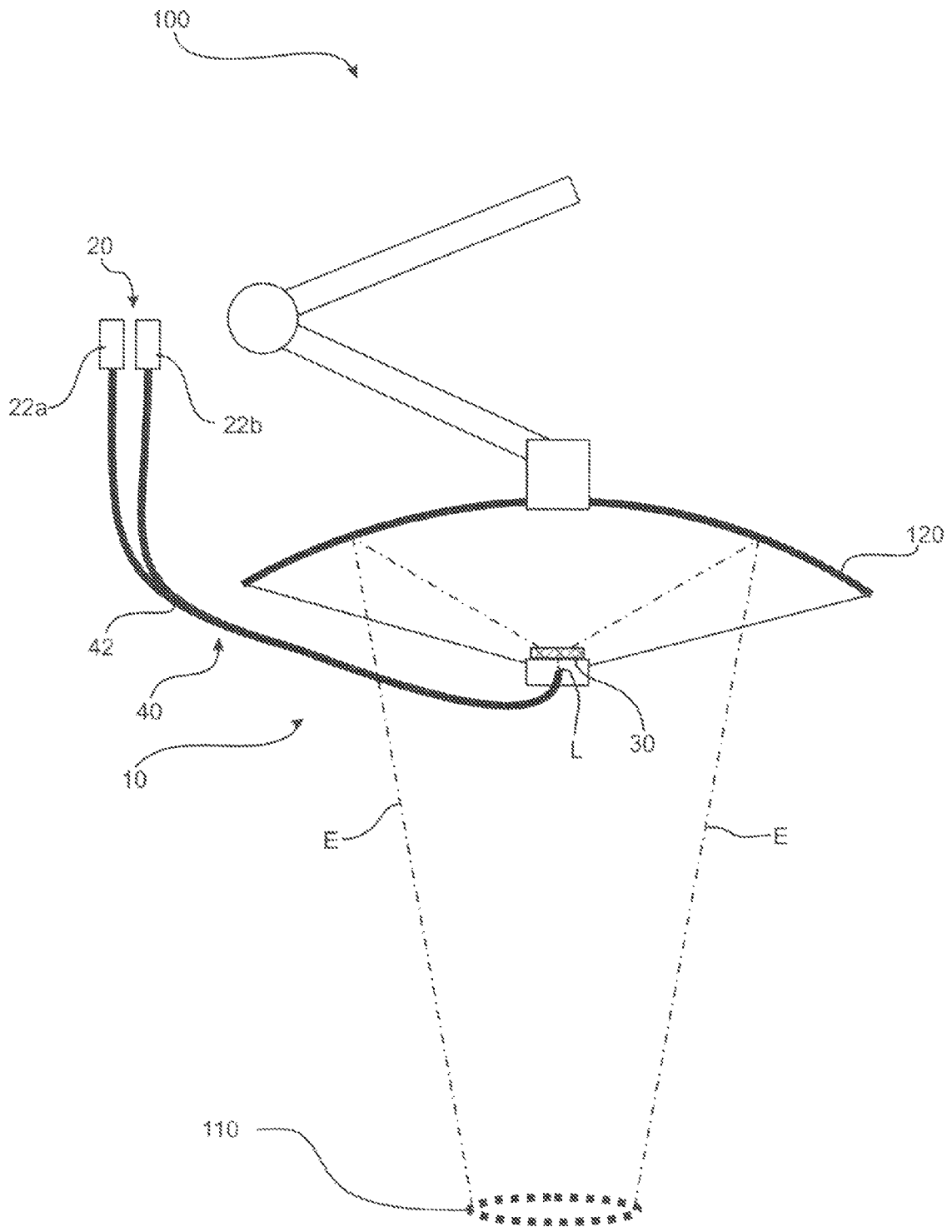
FIG. 2 is a schematic view showing another embodiment of an illuminating device according to the present invention.

FIG. 2 shows another embodiment of an illuminating device 10 according to the present invention in the form of a lighting fixture 100 for an operating room. Two lasers 22*a* and 22*b* are provided as the light source 20 in this embodiment. A combination of the emitted laser light L can be brought about by means of an optical component 40 in the form of an optical light guide 42 and this combined laser light can be guided together towards the exciting medium. The further mode of operation is identical to that in the embodiment according to FIG. 1. It is possible to operate one of the two lasers 22*a*, 22*b* or both lasers 22*a* and 22*b* together in this variant. A broader range of variations can thus be achieved concerning the spectrum of emission light E made available.

Figure 3:
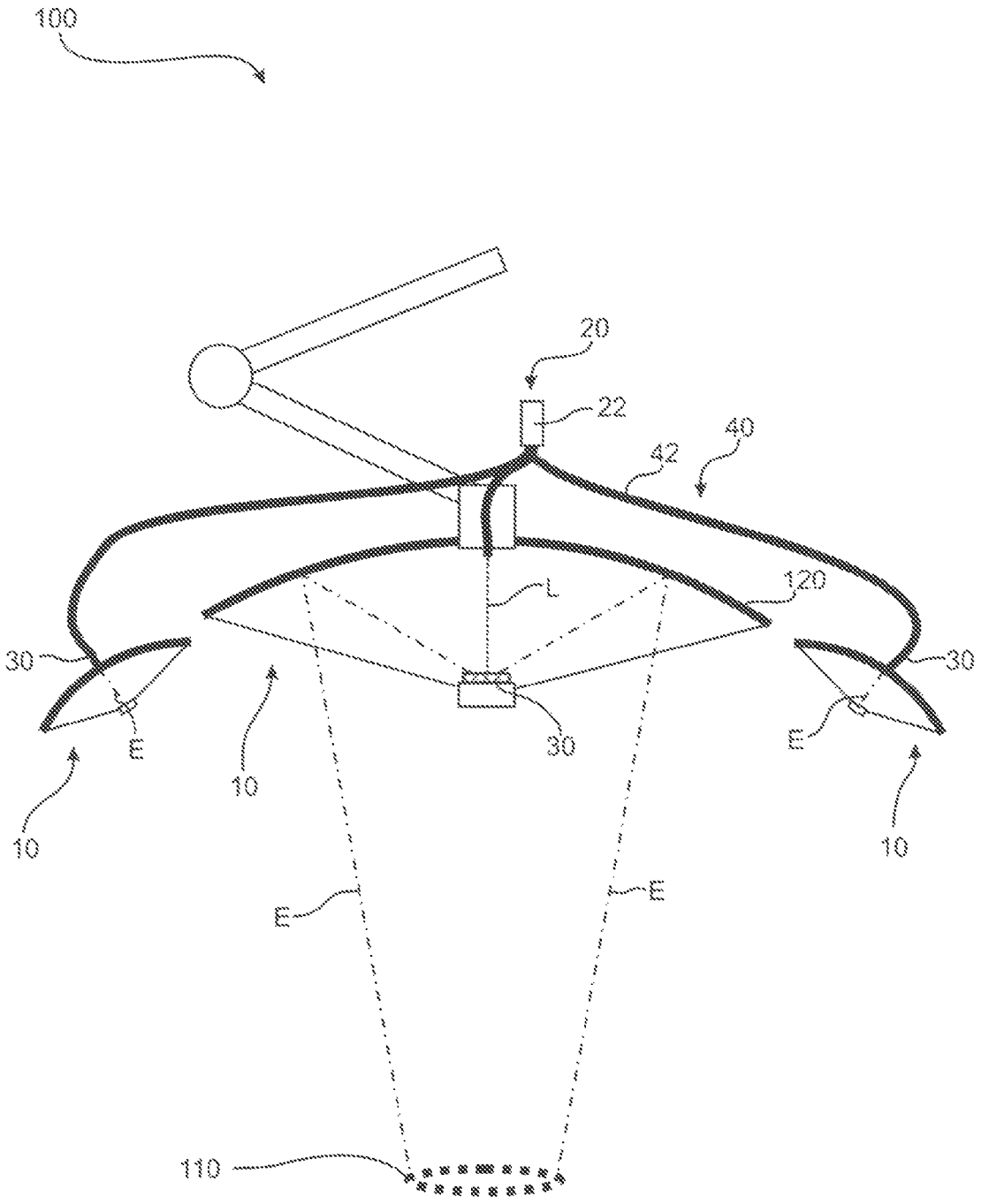
FIG. 3 is a schematic view showing another embodiment of an illuminating device according to the present invention.

FIG. 3 shows another lighting fixture 100 for an operating room. Thus, three illuminating devices 10 according to the present invention are provided here, and the two illuminating devices 10 arranged on the outside (left and right) are made smaller. A common laser 22 can send light to the exciting medium 30 in the middle illuminating device 10 via optical light guides 42. The optical light guides 42 to the left and right arms of the lighting fixture 100 for the operating room are themselves comprised of exciting medium 30, so that emission light exits directly from the light guides. It is, of course, also possible to use a plurality of different lasers 22.

Figure 4:
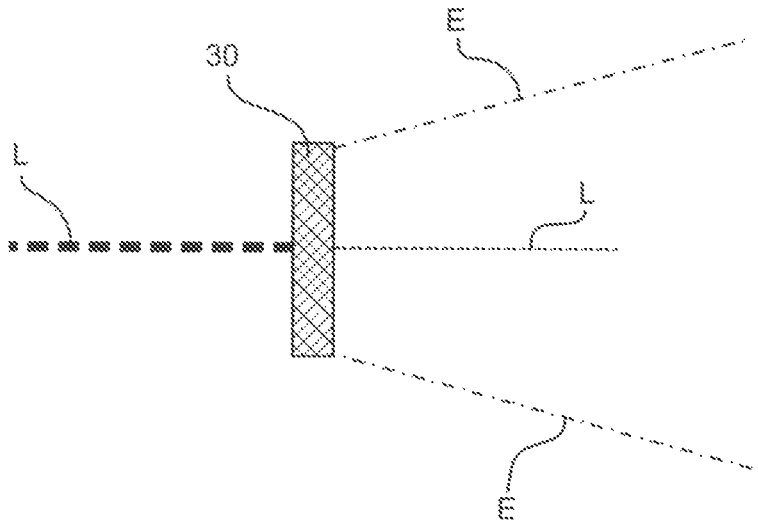
FIG. 4 is a schematic view showing an exciting medium for transmission.
Figure 5:
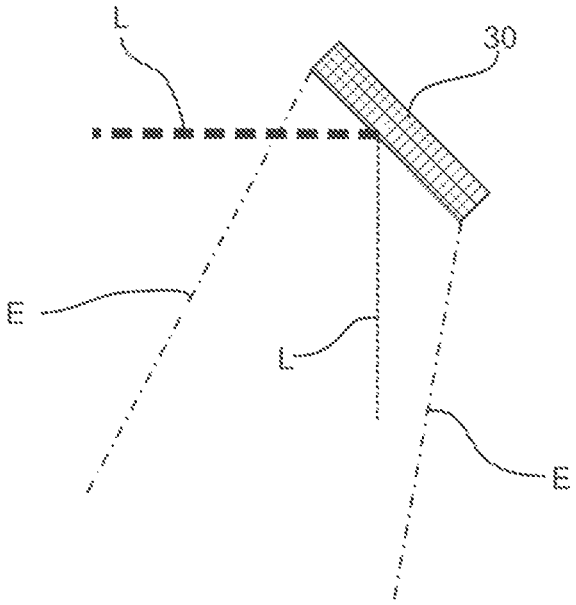
FIG. 5 is a schematic view showing an exciting medium for reflection.

FIGS. 4 and 5 show two different basic concepts for designing the exciting medium 30. Thus, FIG. 4 shows the transmission situation, in which high-energy, monochromatic laser light L falls on the exciting medium 30 from the left. The majority of the laser light L is absorbed in this case, so that only a smaller percentage with a correspondingly lower energy density of laser light L will leave the exciting medium 30 on the right. The rest of the laser light L was converted into emission light E. The exciting medium 30 for the laser light L may also act as a diffuser here.

As an alternative or in addition, the exciting medium 30 may be designed as a reflector, as is shown in FIG. 5. High-energy laser light L is radiated onto the exciting medium 30 here as well and a large part is absorbed, so that laser light L is reflected downwardly with a lower energy density. The rest of the laser light L is converted into emission light E here as well.

Figure 6:
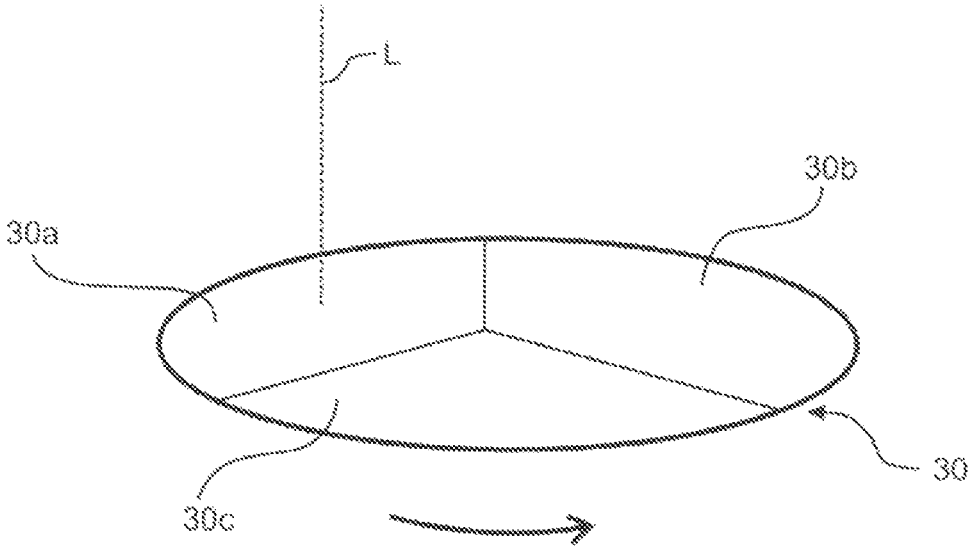
FIG. 6 is a schematic view showing an exciting medium with three excitation sections.

FIG. 6 shows an embodiment of an exciting medium 30 with three different excitation sections 30*a*, 30*b* and 30*c*. These excitation sections 30*a*, 30*b* and 30*c* differ from each other in their chemical composition (material), especially in the type of the photoluminescing material. Thus, a different spectrum of emission light E can be made available depending on the irradiation of different excitation sections 32*a*, 32*b* and 32*c* with laser light L. Consequently, switching over between different spectra of emission light E takes place by rotating the exciting medium 30, as this is indicated by the arrow in FIG. 6. The focusing of the laser light L thus changes, and it is directed straight onto the excitation section 30*a* in the arrangement according to FIG. 6.

The above explanation of the embodiments describes the present invention exclusively within the framework of examples. Individual features of the embodiments, if technically meaningful, may, of course, be freely combined with one another without going beyond the scope of the present invention. While specific embodiments of the invention have been shown and described in detail to illustrate the application of the principles of the invention, it will be understood that the invention may be embodied otherwise without departing from such principles.

The invention claimed is:

1. An illuminating device for illuminating an illuminated area, the illuminating device comprising at least one light source comprising:

at least one laser for the emission of laser light;

at least one exciting medium, which is excited while absorbing at least one part of the laser light and emits emission light of a wavelength that differs at least partly from the wavelength of the laser light, wherein the exciting medium is designed such that the exciting medium scatters a non-absorbed part of the laser light and at least partially destroys the spatial coherence thereof;

at least one optical component arranged such that the optical component guides the laser light onto the exciting medium, the at least one optical component comprising an optical light guide comprised of the exciting medium at least partly.

2. An illuminating device in accordance with claim 1, wherein the exciting medium is designed to emit a spectrum of different frequencies, especially in the form of a frequency band, as an emission light during excitation by the laser light.

3. An illuminating device in accordance with claim 1, wherein the exciting medium has at least two excitation sections, which emit mutually different spectra of emission light while absorbing the laser light.

4. An illuminating device in accordance with claim 3, wherein the exciting medium is arranged movably, in the illuminating device to move one of the excitation sections into the focus of the laser light.

5. An illuminating device in accordance with claim 1, wherein the light source further comprises at least one additional laser such that the light source has at least two lasers, which emit laser light with different wavelengths, both of the different wavelengths being absorbed by the exciting medium to create different excitations.

6. An illuminating device in accordance with claim 1, wherein the laser and/or the exciting medium is designed for the emission of laser light and/or emission light with a UV component in a frequency and with an energy that are suitable for the disinfection of the illuminated area.

7. A lighting fixture for an operating room for illuminating an illuminated area in the form of an operating area, the lighting fixture comprising at least one illuminating device comprising a light source comprising:

a laser source emitting laser light; and an exciting medium receiving the emitted laser light and absorbing a portion of the laser light and emitting emission light of a wavelength that differs at least partly from a wavelength of the laser light, the exciting medium scattering a non-absorbed portion of the laser light and at least partially destroying a spatial coherence of the scattered non-absorbed portion of the laser light;

an optical component guiding laser light to the exciting medium, at least some of the exciting medium being arranged inside the light guide.

8. A lighting fixture for an operating room in accordance with claim 7, further comprising another illuminating device to provide a plurality of illuminating devices arranged movably in relation to one another.

9. A lighting fixture in accordance with claim 8, wherein:

the emission component comprises an additional exciting medium;

the light source further comprises an additional laser, wherein the laser and the additional laser emit laser light with different wavelengths, the different wavelengths being absorbed by the exciting medium and the another exciting medium to create different frequency spectra.

10. A lighting fixture in accordance with claim 8, wherein at least one of the laser and the exciting medium provide an emission of at least one of laser light and emission light with a UV component in a frequency and with an energy for a disinfection of an illuminated area.

11. An operating area illuminating device comprising:

a laser source emitting laser light, said laser source comprising a laser;

an emission component comprising an exciting medium, said exciting medium being arranged to receive the laser light from said laser source, said exciting medium partially absorbing the laser light to emit emission light of a wavelength different from a wavelength of the laser light, said exciting medium scattering a non-absorbed part of the laser light and at least partially destroying the spatial coherence of the non-absorbed part of the laser light, said exciting medium also emitting the non-absorbed part of the laser light.

12. An operating area illuminating device in accordance with claim 11, wherein:

an optical component receives and directs the emission light and the non-absorbed laser light to an operating area of an operating room;

one of the emission light and the non-absorbed laser light directed to the operating area has a UV component with a frequency and with an energy suitable for disinfection of the operating area.

13. An operating area illuminating device in accordance with claim 11, wherein:

a light guide receives the laser light from said laser source, said exciting medium being arranged inside said light guide.

14. An operating area illuminating device in accordance with claim 13, wherein:

said light guide is a Total Internal Reflection body.

15. An illuminating device in accordance with claim 11, wherein:

an optical component receives and guides the laser light from said laser source, said optical component includes one of a reflector, a diaphragm, an optical light guide, a lens, and a diffractive optical system;

said exciting medium is arranged inside said optical component.

* * * * *